US005988070A

United States Patent [19]

Krumm et al.

[11] Patent Number: 5,988,070

[45] Date of Patent: Nov. 23, 1999

[54] PLASMA INJECTION DEVICE FOR AN ELECTROTHERMAL GUN

[75] Inventors: Herbert Krumm, Kaarst; Thomas Weise, Unterlüss; Frank Venier, Essen; Günter Stoffler, Vierkirchen, all of Germany

[73] Assignee: Rheinmetall W & M GmbH, Unterlüss, Germany

[21] Appl. No.: 09/161,735

[22] Filed: Sep. 29, 1998

Related U.S. Application Data

[62] Division of application No. 08/848,836, May 5, 1997, Pat. No. 5,898,124.

[30] Foreign Application Priority Data

May 4, 1996 [DE] Germany ..... 196 17 895

[51] Int. Cl.[6] ..... F42B 5/08

[52] U.S. Cl. ..... 102/430; 102/440; 102/465; 102/472; 89/8

[58] Field of Search ..... 102/430, 440, 102/443, 466, 467, 472; 89/7, 8

[56] References Cited

U.S. PATENT DOCUMENTS

| | | | |
|---|---|---|---|
| 667,435 | 2/1901 | Friese-Greene et al. | 89/8 |
| 3,228,333 | 1/1966 | Phelps et al. | 102/472 |
| 3,756,156 | 9/1973 | Schuster | 102/467 |
| 4,449,458 | 5/1984 | Buckley et al. | 102/430 |
| 5,042,359 | 8/1991 | Witt et al. | 89/8 |
| 5,231,242 | 7/1993 | Chryssomallis et al. | 102/472 |
| 5,287,791 | 2/1994 | Chaboki et al. | 89/8 |
| 5,355,764 | 10/1994 | Marinos et al. | 89/8 |
| 5,444,208 | 8/1995 | Mortensen | 89/8 |
| 5,549,046 | 8/1996 | Widner et al. | 102/472 |
| 5,612,506 | 3/1997 | Goldstein | 102/472 |

*Primary Examiner*—Harold J. Tudor
*Attorney, Agent, or Firm*—Venable; Gabor J. Kelemen

[57] ABSTRACT

A plasma injection device in combination with a projectile includes a reusable multi-part propellant case which has a cartridge base and an electrically insulating case body directly attached to the cartridge base. The case body has an interior, a front end and an opposite rearward end. The rearward end of the case body is directly attached to the cartridge base. The case body has an outer surface for engaging an inner surface of a weapon tube whereby the case body constitutes an obturator. An electrode is held in the cartridge base in direct contact therewith. The electrode extends into the electrically insulating material and is exposed to the interior of the case body. The device further includes a plasma-receiving container having a front end and a rearward end; the rearward end is attached to the front end of the case body. The case body and the plasma-receiving container are substantially consecutively disposed end-to-end. The front end of the plasma-receiving container is in engagement with the projectile, whereby the container is flanked by the case body and the projectile. The propellant case, the plasma-receiving container and the projectile form a structural unit.

6 Claims, 3 Drawing Sheets

PLASMA INJECTION DEVICE FOR AN ELECTROTHERMAL GUN

CROSS REFERENCE TO RELATED APPLICATION

This application is a division of application Ser. No. 08/848,836 filed May 5, 1997, now U.S. Pat. No. 5,898,124, issued Apr. 27, 1999.

BACKGROUND OF THE INVENTION

This invention relates to electrothermal guns and is particularly directed to a plasma injection device for such guns. The device includes a multi-part propellant case. The invention is also directed to a method of making the propellant case.

In electrothermal guns a plasma burner, including a container for the plasma material, inserted at the breechblock of the gun forms part of the ammunition in addition to the projectile. Because of the large quantities to be produced, the ammunition should be as inexpensive as possible.

German Offenlegungsschrift (application published without examination) No. 44 40 829 describes an annular plasma injector, also termed as a plasma burner. Stable, discrete and continuous plasma arcs are generated by a cooperation with a diaphragm element to make possible even distributions, as well as an infusion and permeation of the plasma into a propellant or combustible mass (fuel). The diaphragm element serves as a plasma container and also as a fuel container. Such a construction, however, does not allow for a reuse of the plasma or fuel container or the plasma burner.

German Patent No. 26 41 665 describes conventional propellant containers or cases which are composed of a multi-part, shell-like case bottom, a case stump and an obturating ring.

The multi-part propellant case described in German Offenlegungsschrift No. 38 21 669 is likewise composed of a case bottom (base) and a case stump which carries a rotationally symmetrical part at least partially constituting an ejecting shoulder.

Further, German Offenlegungsschrift 42 29 559 shows a case bottom for large-caliber ammunition. The base plate of the case bottom and the metallic supporting and sealing ring are composed of two separate parts which are connected to one another in a form-fitting manner such that a radial disengagement of the two parts may occur.

None of the above-outlined propellant cases can be used, however, in ammunition for electrothermal guns because such propellant cases do not make possible an electrothermal ignition by means of electrodes and plasma material.

Electrically ignitable cartridge systems are disclosed in German Offenlegungsschrift No. 41 06 186 where the housing is formed of an electrically insulating material. The described housing which includes a striker, however, cannot be used for an electrothermal ammunition because such ammunition is, during ignition, exposed to high pressures and temperatures. Also, a reuse of the housing is not possible.

A disposal of the above-outlined conventional ammunition also causes problems.

SUMMARY OF THE INVENTION

It is an object of the invention to provide an improved plasma burner which may be inexpensively mass-produced and frequently reused.

It is a further object of the invention to provide an improved method of making such a plasma burner.

These objects and others to become apparent as the specification progresses, are accomplished by the invention, according to which, briefly stated, the plasma injection device in combination with a projectile includes a reusable multi-part propellant case which has a cartridge base and an electrically insulating case body directly attached to the cartridge base. The case body has an interior, a front end and an opposite rearward end. The rearward end of the case body is directly attached to the cartridge base. The case body has an outer surface for engaging an inner surface of a weapon tube whereby the case body constitutes an obturator. An electrode is held in the cartridge base in direct contact therewith. The electrode extends into the electrically insulating material and is exposed to the interior of the case body. The device further includes a plasma-receiving container having a front end and a rearward end; the rearward end is attached to the front end of the case body. The case body and the plasma-receiving container are substantially consecutively disposed end-to-end. The front end of the plasma-receiving container is in engagement with the projectile, whereby the container is flanked by the case body and the projectile. The propellant case, the plasma-receiving container and the projectile form a structural unit.

By providing a plasma burner of a novel construction, that is, by combining the propellant case, the container and the plasma material into a single component, a simple integration of the projectile and plasma material is obtained. A further advantage resides in the possibility of an easy integration of the igniting mechanism. The use of a multi-part propellant case in plasma burners for electrothermal guns also makes possible a recycling of the plasma burner.

The process according to the invention results in a lowering of the manufacturing and recycling times of the propellant case and also results in a reduction of material input.

According to a preferred feature of the invention, by means of the inner shape of the propellant case and by means of the insulation, an adapted energy conversion and thus highly satisfactory inner ballistic characteristics are achieved. Providing the insulation between the electrode and the cartridge base and the insulation of the propellant case in a single process step and the time-saving associated therewith are also advantages.

The new selection of material for the cartridge base results in a further material and weight saving.

By using synthetic resin containing compressed wood or fiber reinforced plastic materials, a multi-contact lamina and a special, C-shaped seal for avoiding current-caused erosions may be dispensed with. By virtue of the improved insulation of the electrode (anode), the operational safety of the plasma burner is increased and a limitation of damages in case of malfunctioning of the plasma burner bottom is achieved. Also, costs are being saved.

DESCRIPTION OF THE PREFERRED EMBODIMENTS

Figure 1:
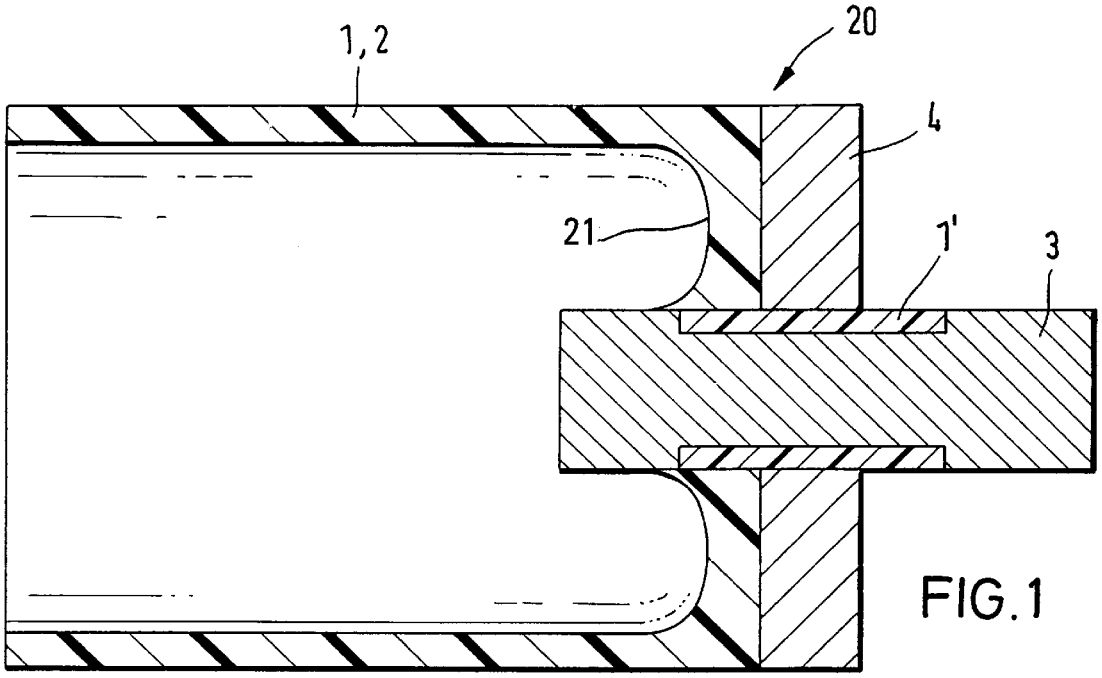
FIG. 1 is a schematic axial sectional view of a propellant case according to a preferred embodiment.

FIG. 1 shows a propellant case generally designated at 20 composed of an electrical insulation 1 which at the same time serves as an obturating member 2, a cartridge base 4 as well as an insulated electrode 3 supported in the cartridge base 4. The insulation 1' of the electrode 3 may be, for example, a wound, fiberglass-reinforced plastic but may also be an integral part of the insulation 1. The electric insulation 1 also serves as the case body of the propellant case 20.

In case a fiberglass-reinforced plastic is used, the latter is wound about the electrode 3, placed in the cartridge base 4 to traverse a preformed aperture therein, and as the plastic is cured, it bonds the electrode 3 to and electrically insulates it from the cartridge base 4. Thereafter the cartridge base 4 is, with the insulated electrode 3, positioned in a conventional mold and by means of a reactive resin mass, the insulator/obturator 1, 2 is obtained.

If the insulation about the electrode 3 is effected without a fiberglass reinforced plastic, the two above-noted process steps may be combined. The cartridge base 4 and the not-yet-insulated electrode 3 are disposed in a correspondingly differently shaped mold so that the cartridge base 4 and the electrode 3 remain out of contact with one another. By means of the reactive resin mass the insulation 1' about the electrode 3 as well as the insulator/obturator 1, 2 is provided. In either instance, the insulator/obturator 1, 2 and the insulation 1' are preferably obtained by linearly cross-linked synthetic materials, such as elastomers. In this procedure the insulator/obturator 1, 2 determines an inner as well as an outer shape of the propellant case 20 at the cartridge base 4. The inner shape is characterized by an annular, cross-sectionally semicircular groove 21 surrounding the electrode 3. The cast, low-shrinkage, flexible synthetic material hardens without the formation of air bubbles. The required accuracy (tolerances) is observed in the making of the mold so that a subsequent machining of the propellant case is not necessary.

Figure 2:
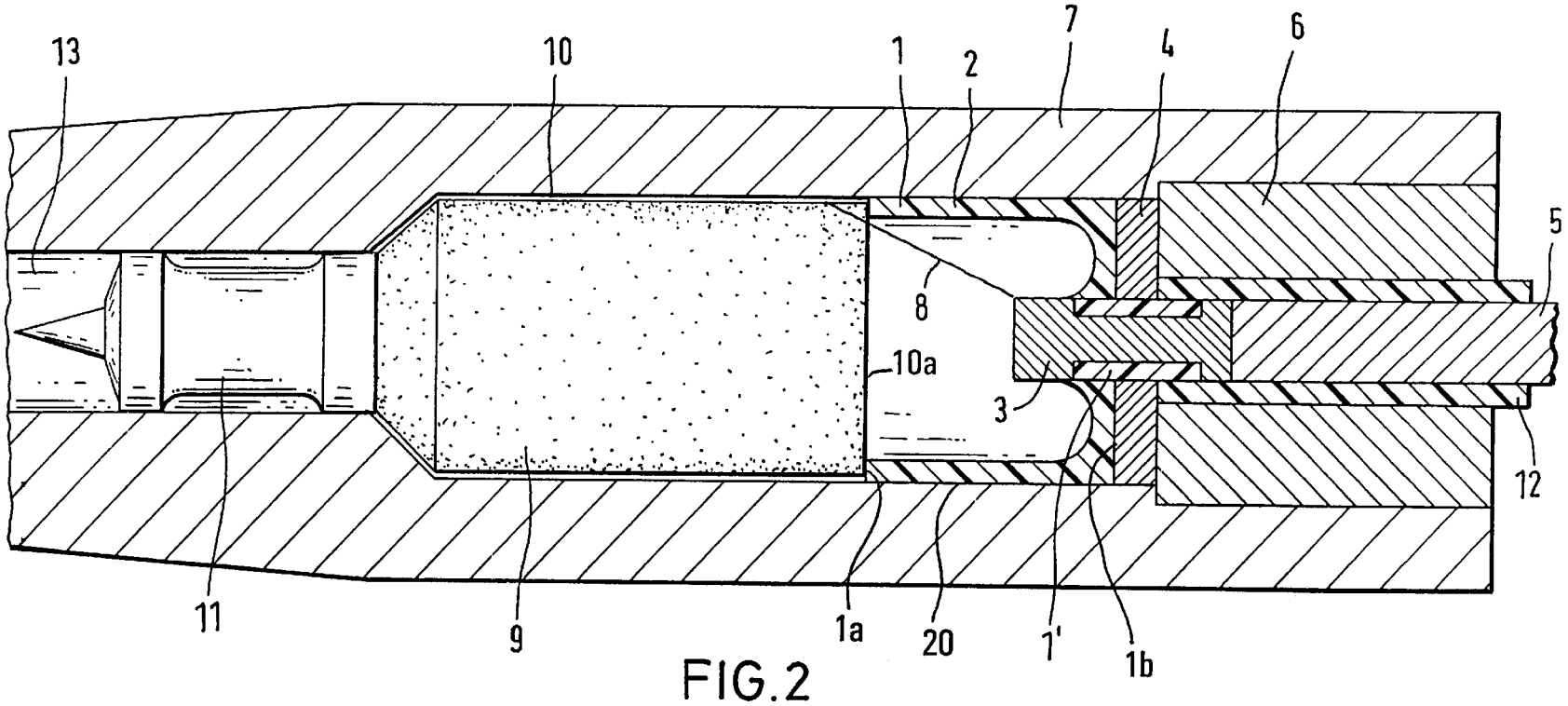
FIG. 2 is a schematic axial sectional view of an annular plasma burner including the construction of FIG. 1 and a projectile disposed in front thereof.

FIG. 2 shows the general structure of an electric gun. A weapon tube 7 closely surrounds a breechblock 6 of the gun. In the breechblock 6 a central electrode 5 is fixedly arranged such that it is electrically insulated from the breechblock 6 by an insulation 12. In the loaded state of the gun the cartridge base 4 of the propellant case 20 is situated at the breechblock 6. The insulated electrode 3 whose one end projects into the propellant case 20 through the cartridge base 4, contacts, with its other end, the central electrode 5. A rearward end 10*a* of a container 10 is coupled with a front end 1*a* of the insulator/obturator 1, 2, for example, by means of a non-illustrated fit and is secured thereto, for example, by gluing. The rearward end 1*b* of the insulator/obturator 1, 2 is attached to the cartridge base 4. The container 10 is subsequently filled with a plasma material 9. The container 10 may be open towards the breechblock, that is, in the direction of the propellant case. In such a case the propellant case 20 is also filled with plasma material. The container 10, however, may have a bottom oriented towards the breechblock. Also, the container 10 may have a taper in the direction of the breechblock to improve the generation of an arc 8 in the plasma material 9. In the weapon tube 7 a projectile 11 is positioned in front of the container 10 and may be attached thereto. According to the invention the multi-part propellant case 20, the container 10 with the plasma material 9 and the projectile 11 may constitute a single structural unit (cartridge).

The plasma injecting device may be annular or rectangular, dependent upon the container 10 used.

By closing an igniting circuit (not described in detail) of the electric gun, the insulated electrode 3 is placed at a positive potential by the central electrode 5. The potential difference between the electrode 3 and the weapon tube 7 which serves as a counterelectrode, effects the generation of an arc 8 to the weapon tube 7.

By means of the arc 8 the plasma material 9, for example, methanol is expanded whereby an electrothermal volume increase occurs which accelerates the projectile 11 in the direction of the muzzle 13 of the tube 7 in a known manner.

The length of the arc 8 depends upon the size of the insulator/obturator 1, 2. In case the insulator/obturator 1, 2 has a substantial length in the direction of the container 10, the plasma voltage has to be selected high which carries the risk that the plasma 9 obtained by a wire explosion collapses. In such a case then the projectile 11 will not be ejected in an optimal manner—if at all—from the tube 7. If the insulator/obturator 1,2 is selected to be too short, the energy conversion and thus the expansion of the plasma material 9 is not sufficient to move the projectile 11 out of the tube 7 with the desired velocity. Also in such a design of the propellant casing 20 the insulation between the steel components placed at different potentials is missing which may lead to the destruction of the electrothermal gun. The inner semicircular groove 21 of the insulator/obturator 1, 2 at the cartridge base 4 effects a directed expansion of the plasma material towards the projectile 11.

By virtue of the above-described measures a well-adapted energy conversion and superior inner ballistic characteristics are obtained.

The container 10 which leaves the weapon tube 7 together with the projectile 11 may burn or twist off the projectile 11. Dependent upon the thickness and quality of the insulator/obturator 1, 2, the propellant case 20 may be reused in which case for each such reuse a new container 10 with new plasma material 9 and a new projectile 11 is inserted.

After repeated use and a predetermined wear of the insulator/obturator 1, 2, the cartridge base 4 and the insulated electrode 3 are again brought into the casting mold and the insulator/obturator 1, 2 is re-cast.

The defined wear is determined by the behavior of fit between the propellant case 20 and the container 10 as well as between the propellant case 20 and the weapon tube 7. In case such fit is no longer satisfactory, the insulator/obturator 1, 2 is renewed before reusing the propellant case 20.

Figure 3:
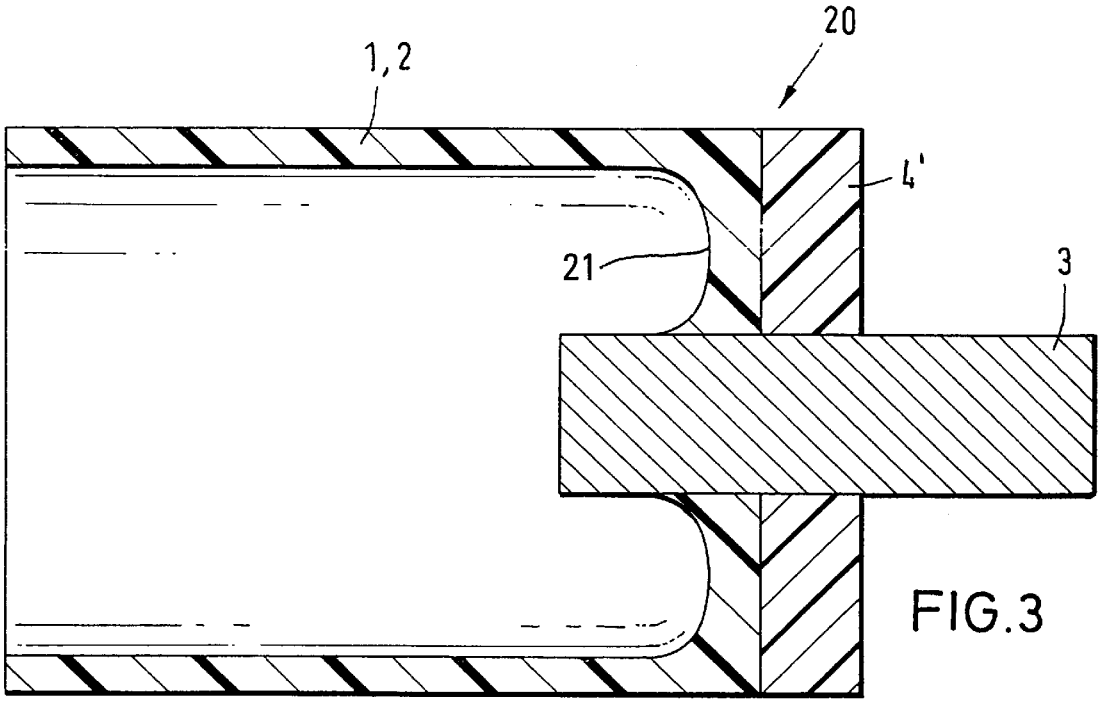
FIG. 3 is an axial sectional view of a propellant case according to another preferred embodiment.

A variant of the propellant case 20 is illustrated in FIG. 3.

The cartridge base 4' is composed of an electrically non-conducting material having an insulation effect for the plasma burner. Appropriate materials for the cartridge base 4' are, for example, synthetic resin containing compressed wood such as layer-bonded Lignostone and fiber-reinforced synthetic materials such as fiberglass-reinforced plastics, for example, Durestone or Duraver as well as synthetic fiber or natural fiber reinforced plastic materials.

Because the cartridge base 4' which is formed of a synthetic resin containing compressed wood, is electrically non-conducting, the electrode does not have to be arranged in an electrically insulated manner in the cartridge base 4'. One end of the electrode 3 projects through the cartridge base 4' into the propellant case 20. Between the cartridge base 4' and the electrode 3 a material is disposed which provides for a firm seat of the electrode 3 in the cartridge base 4'. For this purpose the electrode 3 is inserted with a small clearance into an aperture of the cartridge base 4', the two components are positioned together in a non-illustrated mold which is then filled with a reactive resin mass, which, after subsequent hardening, forms the insulator/obturator 1, 2 and also constitutes the thin bonding layer between the electrode 3 and the cartridge base 4'. For such a procedure castable, low-shrinkage flexible synthetic materials are used. The electrode 3, however, may also be secured to the cartridge base 4 by means of a press fit or similar procedures without the need to use additional material. Thus, when such procedures are followed, the electrode is already firmly attached to the cartridge base 4' as these two components are introduced into the mold.

Figure 4:
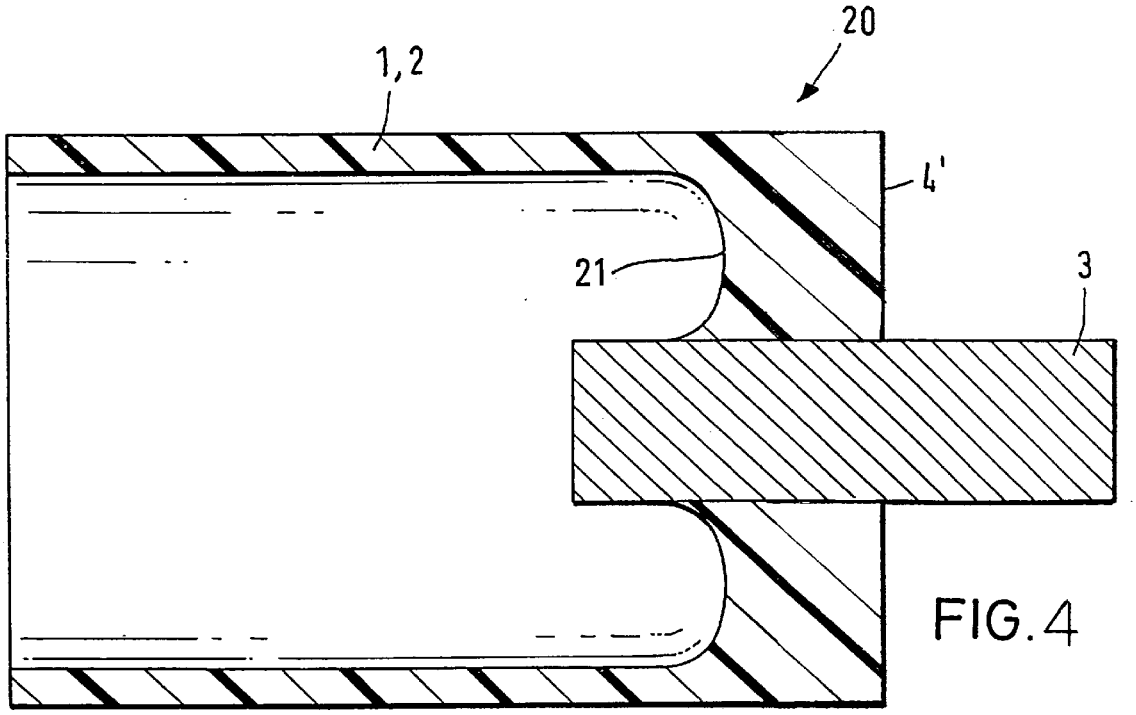
FIG. 4 is an axial sectional view of a propellant case according to yet another preferred embodiment.

According to a variant method of the invention, the electrode 3 is introduced by itself into the mold. The cartridge base 4 and the insulation are cast onto the electrode and are formed of a synthetic material. In this proceeding the cartridge base 4' and the insulator/obturator 1, 2 become a one-piece, integral component as illustrated in FIG. 4. The cartridge-like shape is determined by the inner configuration of the mold.

According to still another variant of the method, the electrode is positioned in a mold of a generally known injection molding tool and the cartridge base 4' as well as the insulator/obturator 1, 2 are formed therein from a reinforced or non-reinforced thermoplastic material such as polyamide or polycarbonate. The thermoplastic materials may be brought to any desired shape under pressure and appropriate temperature. The advantage of this process resides in the short cycle time in the manufacture or renewal.

In the above-discussed cases, after repeated use and defined wear of the insulator/obturator 1, 2, the cartridge base 4' is again placed in a mold with the electrode 3 to renew the insulator/obturator 1, 2.

It will be understood that the above description of the present invention is susceptible to various modifications, changes and adaptations, and the same are intended to be comprehended within the meaning and range of equivalents of the appended claims.

What is claimed is:

1. A plasma injection device in combination with a projectile, comprising (a) a reusable multi-part propellant case including (1) a cartridge base made of an electrically insulating material and having an outer surface for engaging an inner surface of a weapon tube;

(2) a case body made of an electrically insulating material; said case body extending directly from said cartridge base; said case body having an interior and a front end; said case body having an outer surface for engaging an inner surface of the weapon tube whereby said case body constitutes an obturator; and (3) an electrode held in and passing through said cartridge base in direct contact therewith; said electrode extending into said electrically insulating material of said case body and being exposed to said interior; and (b) a plasma-receiving container having a front end and a rearward end; said rearward end of said plasma-receiving container being attached to said front end of said case body; said case body and said plasma-receiving container being substantially consecutively disposed end-to-end; said front end of said plasma-receiving container being in engagement with said projectile, whereby said container is flanked by said case body and said projectile; said propellant case, said plasma-receiving container and said projectile forming a structural unit.

2. The plasma injection device as defined in claim 1, wherein said cartridge base forms an integral, one-piece part with said case body.

3. The plasma injection device as defined in claim 1, wherein said insulating material of said cartridge base d said case body is synthetic resin containing compressed wood.

4. The plasma injection device as defined in claim 1, wherein said insulating material of said cartridge base and said case body is a fiber-reinforced synthetic material.

5. The plasma injection device as defined in claim 1, wherein said case body is attached directly to said cartridge base and wherein said cartridge base and said case body are two separate components.

6. The plasma injection device as defined in claim 5, wherein said cartridge base and said case body are in an end-to-end abutting relationship with one another.

* * * * *